United States Patent [19]

Carver

[11] 4,301,550

[45] Nov. 24, 1981

[54] CONVENIENT COMFORT CROTCH PANTYHOSE

[76] Inventor: Gladys Carver, P.O. Box 889, Los Gatos, Calif. 95030

[21] Appl. No.: 159,802

[22] Filed: Jun. 16, 1980

[51] Int. Cl.[3] ..... A41B 9/04

[52] U.S. Cl. ..... 2/408; 2/409; 66/177

[58] Field of Search ..... 2/408, 409, 402, 403, 2/405; 66/177, 176, 196, 197

[56] References Cited

U.S. PATENT DOCUMENTS

| | | | |
|---|---|---|---|
| 369,549 | 9/1887 | Persch | 2/408 X |
| 2,852,780 | 9/1958 | Gold | 2/408 |
| 3,398,739 | 8/1968 | Marino | 2/408 X |

*Primary Examiner*—H. Hampton Hunter

*Attorney, Agent, or Firm*—David A. Boone; Jon R. Stark

[57] ABSTRACT

An opening is provided in a pantyhose garment in which the panty portion comprises a double knit fabric material which by its construction presents overlapping flaps which by digital manipulation expose the opening through which urination can be accomplished without any removal or partial removal of the pantyhose garment.

5 Claims, 4 Drawing Figures

CONVENIENT COMFORT CROTCH PANTYHOSE

BACKGROUND OF THE INVENTION

Various women's undergarments are available which are combination underpants or "panties" and stockings. These pantyhose as they are commonly called are generally regarded by adult women as necessary to be completely dressed up for a formal or semi-formal engagement.

These garments provide a particular problem for elderly or infirm women who because of some disability or simply a lack of strength must struggle with these garments in order to urinate. These difficulties for an elderly woman with weak bladder control can cause difficulties which result in embarassing and frustrating "accidents" which result in the evening's festivities being cut short or a very uncomfortable remainder of the evening.

Prior attempts at these problems are typified by U.S. Pat. No. 3,398,739 entitled "Panty with Openable Crotch", issued to Nicholas A. Marino; and U.S. Pat. No. 2,852,780 entitled "Divided Panties for Women and Children" issued to George Gold. These prior attempts had the disadvantages that their multipart and seamed construction provided an uncomfortable and sometimes so irritating a garment to the sensitive female area that the aforementioned difficulties and embarassment were more tolerable and thus preferred over the attempted solutions.

In accordance with the preferred embodiment of the present invention, an opening is provided in a pantyhose garment in which the panty portion comprises a double knit fabric material which by its construction presents overlapping flaps which by digital manipulation expose the opening through which urination can be accomplished without any removal or partial removal of the pantyhose garment.

DESCRIPTION OF THE PREFERRED EMBODIMENT

Figure 1:
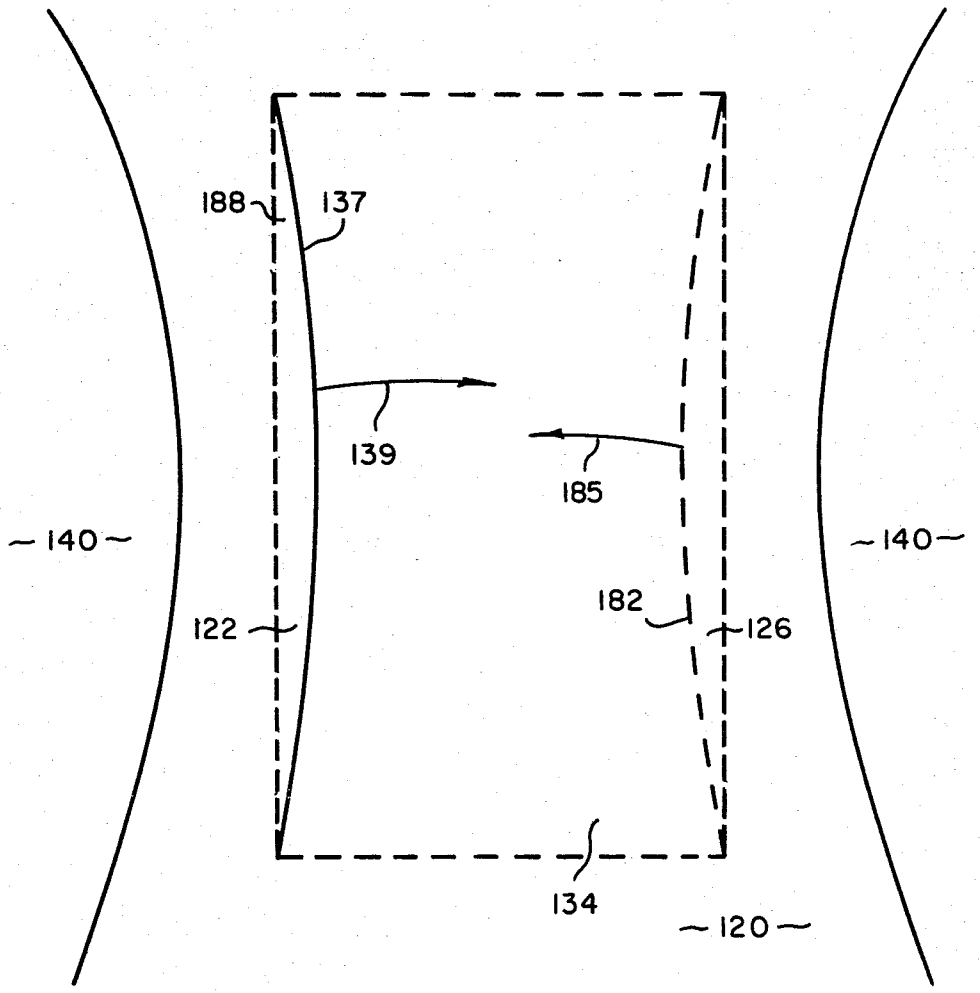
FIG. 1 illustrates the convenience opening in the crotch portion of pantyhose in accordance with the preferred embodiment of the present invention.

Referring now to FIG. 1, there is shown a top view of the crotch portion of pantyhose in accordance with the preferred embodiment of the present invention. The material of crotch portion 120 is a part of an essentially continuous knit of the panty portion of the panty hose garment. This upper panty portion is coupled to the leg or "hose" portion 140 of the garment.

Two slit openings are provided in the crotch portion 120 of the garment, i.e., slit openings 122 and 126. Note that essentially two flap portions are presented.

A top or outer panel 134 is provided over a lower or inner panel 188. It should be noted carefully that this double panel construction is formed without the use of seams as might have been done previously by joining distinctly separate pieces of material together. This unique feature of the construction of the preferred embodiment is discussed in more detail below with respect to FIG. 3.

Slit opening 122 is directly accessible for digital manipulation. In contrast, slit opening 126 is not accessible from the outside of the garment portion thus constructed without some manipulation of the upper flap portion 134. Typically this manipulation is intended to entail the grasping of edge 137 and the pulling of it in the direction shown by arrow 139. This operation exposes inner flap 188 and allows edge 182 to be grasped and pulled in the direction shown by arrow 185.

Figure 2:
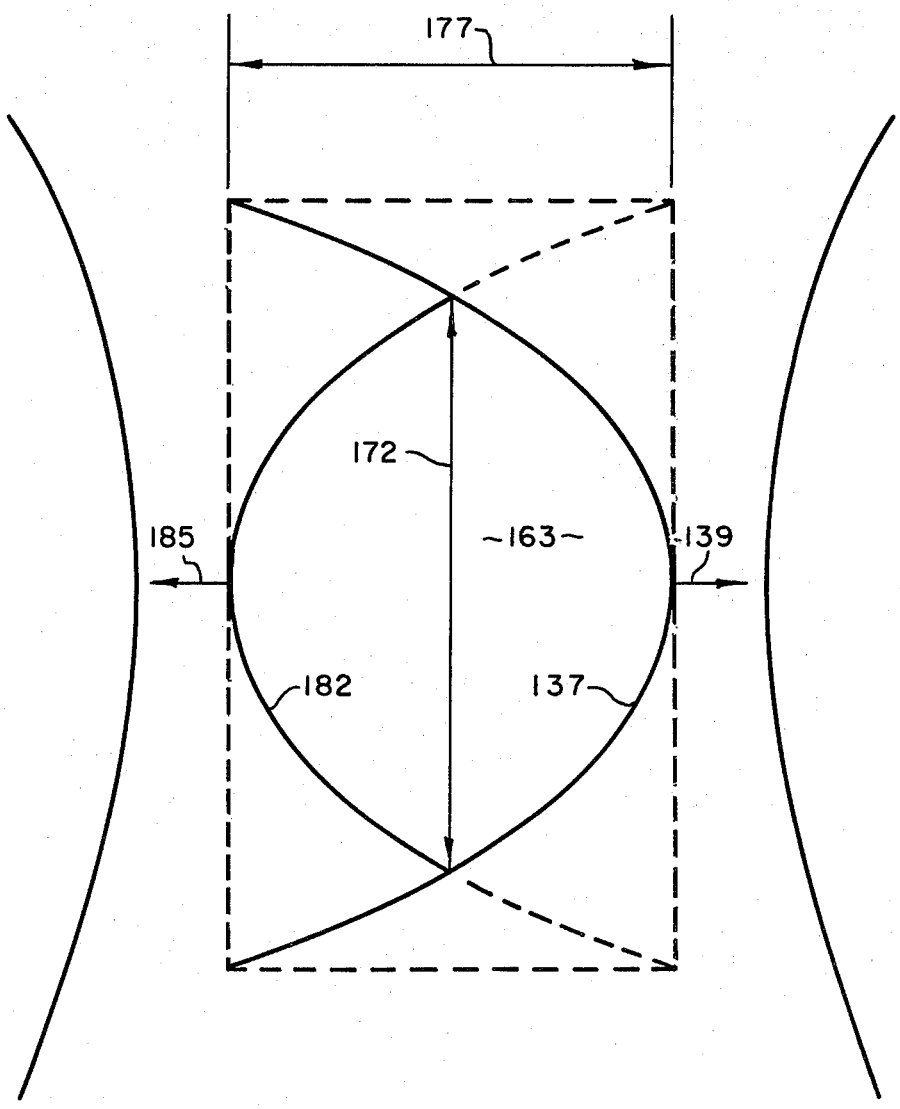
FIG. 2 illustrates the convenience opening in the crotch portion of the pantyhose of the preferred embodiment.

This manipulation of the flap portions results in the positioning of the flaps 134 and 188 as shown in FIG. 2 and the exposing of the body surface below. Preferably, the opening 163 thus provided has a longitudinal dimension 172 and a lateral dimension 177 sufficiently great to allow convenient use of the opening for elimination.

Crotch length from front to back will be from ten to twelve inches on average, but should be longer for large sizes. This should be higher in back to allow bowel movement and high enough in the front pubic area to allow sanitary changes or other personal uses, but not so high as to cause lines in slacks or dresses. The crotch width will extend to the edge or near the edge of the panty top where it joins the legs.

For additional strength, each flap at the top may be stitched to the panty as are their outer edges. The inner edges of both flaps may additionally be curved slightly concave or inward, to allow easier spreading, and have elastic thread or edging to hold each in place without sagging after continued use may be utilized. Any stitching or reinforcement of this type should be kept to a minimum as any bulk or irregularity in the surface of the garment may become a source of discomfort or irritation.

Figure 3:
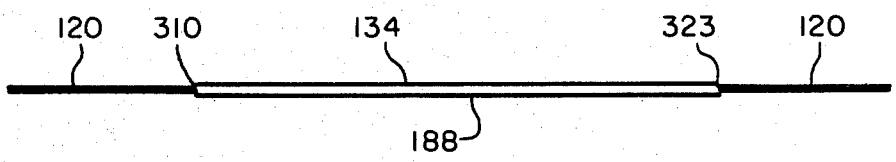
FIG. 3 illustrates the seamless providing of the panels forming the convenience opening using double knit material.

FIG. 3 illustrates the technique used in the preferred embodiment to provide a continuous structure which allows the seamless construction of the convenience opening. The material 120 forming the panty portion of the pantyhose may provide the slits 126 and 122 in either of two ways. For one, a double knit material may be knitted so that the material weave separates and joins back together at points 310 and 323 as illustrated. The advantage of this technique is that the double flap portion of the crotch area is no thicker than the surrounding material. Since this type of multiple layer knit material is frequently used for these panty portions because of its stretch characteristics to give support, no increase in material cost is needed. Another technique which could be used is to use two layers of material which are joined together all over except in the areas defining the two flaps.

Figure 4:
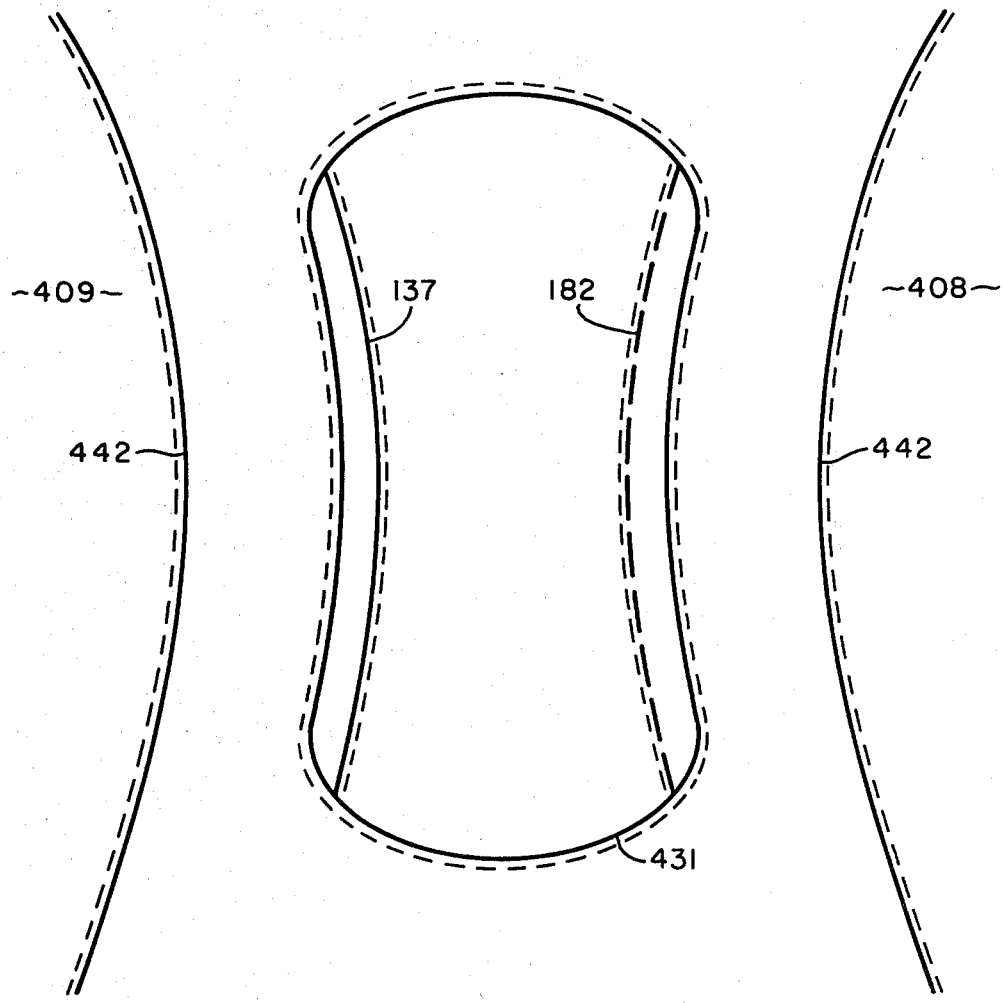
FIG. 4 illustrates an alternate embodiment which utilizes curved flaps and elastic thread about the edges to maintain the shape of the convenience opening.

FIG. 4 illustrates the type of crotch opening having the elastic thread reinforcement along the edges of the slits and the area thereabout. This added feature minimizes the chance that stretching of the material in use will result in deformation of the material which results in the opening remaining open or not lying flat and smooth after use. The elastic thread or other reinforcement is provided on edges 137 and 182. Also it is provided as an outline pattern 431 about the area defining the two flaps. This use of the elastic thread helps pull the crotch portion back into position after use. Another double knit transition 422 is indicated in this figure as the change from the heavier weight knit forming the panty portion to the lighter or sheer material for the leg or hose portion of the garment, i.e., between the panty material 120 and the leg portions 408 and 409. No seam is used because it would show through clothing and be a source of discomfort or binding.

Typically, the panty top is made of a heavier more durable weight than are the legs. The crotch flaps are made of a semi-sheer two-way stretch knit, to eliminate bulk due to the double thickness of the top and bottom flaps.

A convenient comfort crotch which eliminates continual struggling in and out of pantyhose during the day or evening, and puts an end to twisted wrinkled hose when time and care is not taken to pull them back in place. It also helps those who suffer irritations from the see-saw of a tight seam when very active. It is especially convenient for those with weak bladders, arthritis or other infirmities. It can be used for young or old and as a convenience for any type of body garment, and eliminate the dressing and undressing problems while is use.

I claim:

1. A pantyhose garment for females, having a crotch portion comprising a piece of substantially continuous knit fabric which forms two substantially overlapping panels which are defined by two slit openings running substantially parallel to each other and along a front-to-back direction, whereby a crotch opening may be provided by digitally manipulating the overlapping panels presented by pulling each panel in a direction orthogonal to the slit openings, the slit openings being positioned so that neither slit opening crosses any seams in the crotch portion.

2. The pantyhose type garment as in claim 1 wherein the edges of said overlapping panels have bias means attached thereto for maintaining the panels in the closed position.

3. The pantyhose type garment as in claim 2 wherein said bias means comprises elastic thread.

4. The pantyhose type garment as in claim 1 wherein the continuous knit fabric of said crotch portion separates into said two overlapping panels which define slit openings at opposite sides of the crotch area.

5. The pantyhose garment as in claim 4 wherein said two overlapping panels each are substantially one-half the thickness of the continuous knit fabric comprising the adjoining portion of said crotch area.

* * * * *